US009182691B2

(12) United States Patent
Lawton et al.

(10) Patent No.: US 9,182,691 B2
(45) Date of Patent: Nov. 10, 2015

(54) CONTINUOUS TONER COALESCENCE PROCESSES

(71) Applicant: Xerox Corporation, Norwalk, CT (US)

(72) Inventors: David John William Lawton, Stoney Creek (CA); David R. Kurceba, Hamilton (CA); Edward Graham Zwartz, Mississauga (CA); Daniel McDougall McNeil, Georgetown (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/057,504

(22) Filed: Oct. 18, 2013

(65) Prior Publication Data

US 2015/0111151 A1 Apr. 23, 2015

(51) Int. Cl.
*G03G 9/08* (2006.01)

(52) U.S. Cl.
CPC ..... *G03G 9/0827* (2013.01); *G03G 9/0802* (2013.01); *G03G 9/0804* (2013.01); *G03G 9/0819* (2013.01)

(58) Field of Classification Search
CPC . G03G 9/0802; G03G 9/0819; G03G 9/0827; G03G 9/0804
USPC ..... 430/137.1, 137.14
See application file for complete search history.

(56) References Cited

U.S. PATENT DOCUMENTS

2007/0020553 A1* 1/2007 Marcello et al. ..... 430/137.14
2009/0036603 A1* 2/2009 Saita et al. ..... 524/745
2012/0183898 A1* 7/2012 Faucher et al. ..... 430/137.14

* cited by examiner

*Primary Examiner* — Thorl Chea
(74) *Attorney, Agent, or Firm* — Richard M. Klein; Fay Sharpe LLP

(57) ABSTRACT

Processes for continuously coalescing particles from an aggregated particle slurry are disclosed. An aggregated particle slurry is further heated in a first heat exchanger, and the heated slurry then flows through a residence time reactor. The slurry, now containing coalesced particles, then flows through a second heat exchanger and is quenched. The recovered coalesced particle slurry is then suitable for washing and drying. No moving parts are needed in this system.

15 Claims, 13 Drawing Sheets

CONTINUOUS TONER COALESCENCE PROCESSES

BACKGROUND

The present disclosure relates to processes for coalescing toner particles made using emulsion/aggregation (E/A) processes, and incorporating continuous ramp and coalescence processes. These processes can be used to produce toner compositions.

Toner compositions are used with electrostatographic, electrophotographic or xerographic print or copy devices. In such devices, an imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving substrate such as paper.

Emulsion aggregation (EA) toners are used in forming print and/or xerographic images. Emulsion aggregation techniques typically involve the formation of an emulsion latex of resin particles that have a small size of from, for example, about 5 to about 500 nanometers in diameter. Batch processes for producing resins may be subjected to bulk polycondensation polymerization in a batch reactor at an elevated temperature. The resulting resin in then cooled, crushed, and milled prior to being dissolved into a solvent. The dissolved resin is then subjected to a phase inversion process where the polyester resin is dispersed in an aqueous phase to prepare polyester latexes. The solvent is then removed from the aqueous phase by a distillation method. A colorant dispersion, for example of a pigment dispersed in water, optionally with additional resin, may be separately formed. The colorant dispersion may be added to the emulsion latex mixture, and an aggregating agent or complexing agent may then be added and/or aggregation may otherwise be initiated to form aggregated toner particles. The aggregated toner particles may be heated to enable coalescence/fusing, thereby achieving aggregated, fused toner particles.

Exemplary emulsion aggregation toners include acrylate-based toners, such as those based on styrene acrylate toner particles as illustrated in, for example, U.S. Pat. No. 6,120,967, the disclosure of which is totally incorporated herein by reference.

In conventional EA processes, batch processes may be used for preparing toners. Batch processes feature long processing times and consume a great deal of energy. The ramp/coalescence process is particularly time and energy intensive, as the entire batch is ramped to the desired coalescence temperature and maintained at that temperature for coalescence to occur. For example, in large-scale production of EA toner, increasing the temperature of toner to the desired coalescence temperature and carrying out the coalescence step may take upwards of 10 hours.

Additionally, in a batch process, high jacket temperatures and low fluid velocity at the walls under stirring can lead to fouling of the reactor walls. This necessitates additional down-time in the production cycle to allow for cleaning in order to restore the heat transfer from the jacket to the fluid in the vessel. This additional down-time further increases the total amount of time for running an extended production cycle to allow for cleaning after a set number of batches.

It would be desirable to provide coalescence processes that allow for the preparation of toner in a manner that is more efficient, takes less time, results in a consistent toner product, and possibly reduces energy consumption.

BRIEF DESCRIPTION

The present disclosure relates to continuous processes for producing coalesced particles, such as coalesced toner particles. Generally, an emulsion-aggregated polyester particle slurry in a holding tank is pH adjusted downwards (i.e. to be more acidic). The aggregated polyester particle slurry is then heated in a first heat exchanger beyond its glass transition temperature, then optionally flows through a residence time reactor. The particles coalesce to form a coalesced particle slurry. The coalesced particle slurry is then quenched to below the glass transition temperature of the polymer. The quenching may occur, for example, in a second heat exchanger.

Disclosed in various embodiments is a continuous process for coalescing particles, comprising: heating an aggregated polyester particle slurry to a first temperature beyond its glass transition temperature in a first heat exchanger to form a coalesced particle slurry; quenching the coalesced particle slurry to a second temperature below the glass transition temperature after a sufficient residence time; and recovering the quenched coalesced particle slurry at an outlet.

The aggregated polyester particle slurry may have a starting temperature of from ambient to about 65° C. prior to entering the first heat exchanger. The first temperature may be from about 70° C. to about 110° C.

The quenching can occur in a reactor, in a second heat exchanger, a cooled receiving tank, or any other means known to those skilled in the art of process engineering. In particular embodiments, the heated polyester particle slurry exits the first heat exchanger and coalesces in a residence time reactor to form the coalesced particle slurry. Particle coalescence may begin in the first heat exchanger, and then be completed in the residence time reactor. The function of the residence time reactor may also be accomplished by a sufficiently large first heat exchanger such that the coalescence may be completed without flowing through a separate residence time reactor.

Sometimes, the aggregated polyester particle slurry is metered into the first heat exchanger by a pump at the outlet. Sometimes, the aggregated polyester particle slurry may be metered into the system by placing a pump at the inlet. Generally, any means of passing the slurry through the system can be used.

The aggregated particle slurry may have a starting pH of about 5 to about 9 prior to entering the first heat exchanger.

The process may further comprise lowering the pH of the aggregated particle slurry prior to flowing the aggregated particle slurry through the residence time reactor. Sometimes, the pH of the aggregated particle slurry is lowered to a value from about 5 to about 9 prior to entering the first heat exchanger. The pH of the aggregated particle slurry can be lowered by addition of a buffer solution or an acidic solution prior to being fed into the system. The pH may be lowered in the feed tank or alternatively, may be lowered by inline injection of buffer or acidic solution. In other embodiments, the pH of the aggregated particle slurry is lowered after passing through the first heat exchanger.

The residence time can be from about 10 seconds to about 15 minutes.

In various embodiments, heat energy captured from partially quenching the coalesced particle slurry in the second heat exchanger is operatively transferred to the first heat exchanger.

Also disclosed in various embodiments is an apparatus for continuous coalescence of particles, comprising: a passage having an inlet and an outlet, the passage flowing sequentially through a first heat exchanger, a residence time reactor, and a cooling device.

In particular embodiments, the cooling device is a second heat exchanger or a cooled receiving tank.

The apparatus may further comprise a recycle loop wherein heat energy is captured between the residence time reactor and the cooling device, and transferred to fluid upstream of the residence time reactor. The recycle loop can comprise a third heat exchanger located between the residence time reactor and the cooling device, and a fourth heat exchanger located upstream of the first heat exchanger, wherein a heat transfer fluid flows in a loop between the third heat exchanger and the fourth heat exchanger. The fluid can be an oil, such as glycol.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 4A (top left) is a micrograph at 3,000× magnification. FIG. 4B (top right) is another micrograph of the particles at 3,000× magnification. FIG. 4C (bottom left) is a micrograph at 15,000× magnification. FIG. 4D (bottom right) is a micrograph at 25,000× magnification.

FIG. 5A (top left) is a micrograph at 3,000× magnification. FIG. 5B (top right) is another micrograph of the particles at 3,000× magnification. FIG. 5C (bottom left) is a micrograph at 15,000× magnification. FIG. 5D (bottom right) is a micrograph at 25,000× magnification.

FIG. 6A (top left) is a micrograph at 3,000× magnification. FIG. 6B (top right) is another micrograph of the particles at 3,000× magnification. FIG. 6C (bottom left) is a micrograph at 15,000× magnification. FIG. 6D (bottom right) is a micrograph at 25,000× magnification.

FIG. 7A (top left) is a micrograph at 3,000× magnification. FIG. 7B (top right) is another micrograph of the particles at 3,000× magnification. FIG. 7C (bottom left) is a micrograph at 15,000× magnification. FIG. 7D (bottom right) is a micrograph at 25,000× magnification.

DETAILED DESCRIPTION

Figure 1:
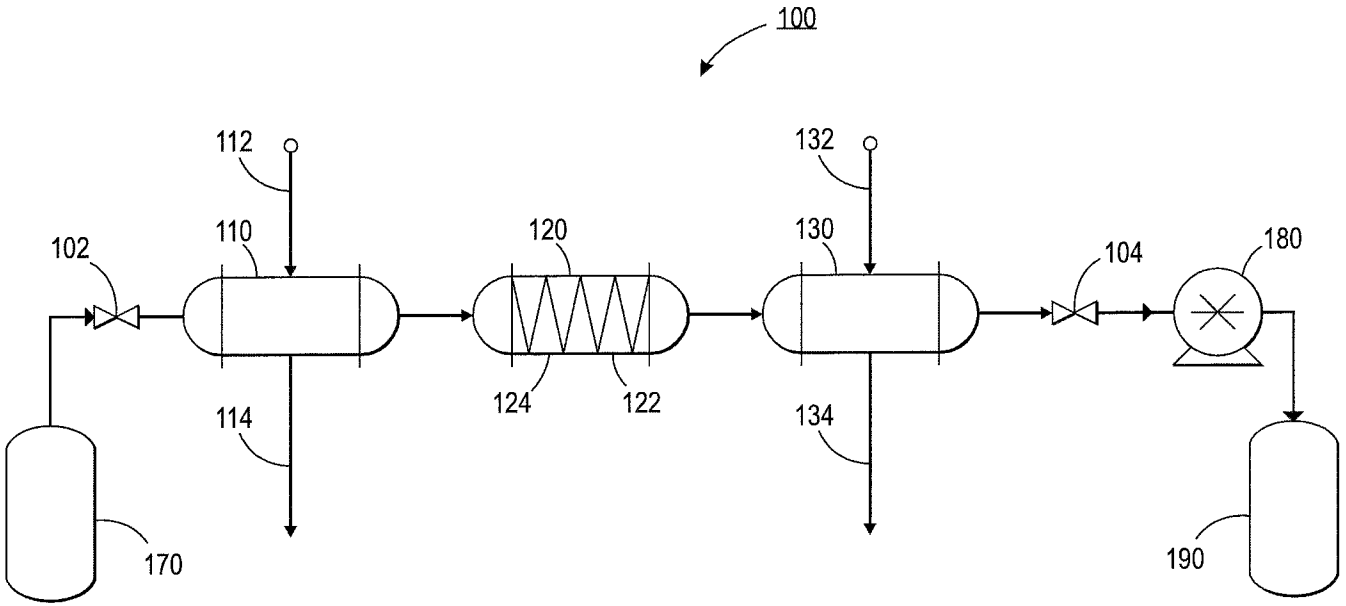
FIG. 1 is a schematic diagram illustrating a first exemplary apparatus suitable for practicing the processes of the present disclosure. This apparatus includes a first heat exchanger for heating the slurry, a residence time reactor, and a second heat exchanger for quenching the slurry.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4."

The term "continuous" refers to a system where the inlet flow rate corresponds to the outlet flow rate and the flow of material in and out of the system occurs simultaneously. However, it should be understood that this material flow may be periodically stopped, for example for maintenance purposes.

The continuous processes disclosed herein are used to produce coalesced particles, particularly coalesced toner compositions. Generally, an aggregated polyester particle slurry has a starting temperature, which may or may not be above ambient. This aggregated polyester particle slurry is then drawn through a first heat exchanger to heat the aggregated particle slurry to a first operating temperature that is greater than the glass transition temperature of the polyester, which in some particular embodiments is from about 70° C. to about 110° C., or from about 80° C. to about 96° C. As a result, the aggregated particles coalesce to form a coalesced particle slurry. The coalescence process can occur in a residence time reactor, and depending on the size of the first heat exchanger can also begin within the first heat exchanger. The coalesced particle slurry is then quenched to reduce the temperature of the coalesced particle slurry to a second temperature below the glass transition temperature of the polyester. The coalesced particle slurry can then be recovered at an outlet of the process.

The processes described herein can allow heat energy to be recovered from the quenched coalesced particle slurry, reducing overall energy consumption. Because smaller quantities of material are processed at a time, quality control may be easier. Lot-to-lot variation can be reduced as well due to the control of temperature and other process parameters. In contrast, the reaction vessel used in a batch process is generally very large, which results in inhomogeneities between the material near the sides of the reaction vessel and the material in the center of the reaction vessel.

The Aggregated Particle Slurry

The processes of the present disclosure begin with an aggregated particle slurry. The aggregated particle slurry contains aggregated particles in water. The aggregated particles may include a resin (i.e. latex), an emulsifying agent (i.e. surfactant), a colorant, a wax, an aggregating agent, a coagulant, and/or additives.

In the processes of the present disclosure, the resin is a polyester resin, such as the resins described in U.S. Pat. Nos. 6,593,049 and 6,756,176, the disclosures of each of which are hereby incorporated by reference in their entirety. Mixtures of polyester resins are also contemplated. For example, the latex may also include a mixture of an amorphous polyester resin and a crystalline polyester resin as described in U.S. Pat. No. 6,830,860, the disclosure of which is hereby incorporated by reference in its entirety.

In some embodiments, as described above, the resin may be a polyester resin formed by the polycondensation process of reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodium 2-sulfo-1,2-ethanediol, lithium 2-sulfo-1,2-ethanediol, potassium 2-sulfo-1,2-ethanediol, sodium 2-sulfo-1,3-propanediol, lithium 2-sulfo-1,3-propanediol, potassium 2-sulfo-1,3-propanediol, mixture thereof, and the like. The aliphatic diol may be, for example, selected in an amount of from about 40 to about 60 mole percent of the resin, and the alkali sulfo-aliphatic diol may be selected in an amount of from about 1 to about 10 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodium, lithium or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfoterephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, from about 40 to about 60 mole percent of the resin, and the alkali sulfo-aliphatic diacid may be selected in an amount of from about 1 to about 10 mole percent of the resin.

Some specific crystalline polyester resins may include poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), and poly(octylene-adipate), wherein alkali is a metal like sodium, lithium or potassium.

The crystalline polyester resin may be present, for example, in an amount of from about 5 to about 30 percent by weight of the toner components (i.e. the slurry minus the aqueous phase), including from about 15 to about 25 percent by weight. The crystalline resin may possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_W$) of, for example, from about 2,000 to about 100,000, in embodiments from about 3,000 to about 80,000, as determined by Gel Permeation Chromatography using polystyrene standards. The molecular weight distribution ($M_W/M_n$) of the crystalline resin may be, for example, from about 2 to about 6, in embodiments from about 2 to about 4.

Alternatively, the polyester resin may be an amorphous polyester. Examples of diacid or diesters selected for the preparation of amorphous polyesters include dicarboxylic acids or diesters such as terephthalic acid, phthalic acid, isophthalic acid, furnaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be selected, for example, from about 40 to about 60 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected may vary, and may be, for example, from about 40 to about 60 mole percent of the resin.

Examples of other amorphous resins which may be utilized include alkali sulfonated-polyester resins and branched alkali sulfonated-polyester resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

In addition, polyester resins obtained from the reaction of bisphenol A and propylene oxide or propylene carbonate, and in particular including such polyesters followed by the reaction of the resulting product with fumaric acid (as disclosed in U.S. Pat. No. 5,227,460, the disclosure of which is hereby incorporated by reference in its entirety), and branched polyester resins resulting from the reaction of dimethylterephthalate with 1,3-butanediol, 1,2-propanediol, and pentaerythritol may also be used.

The molecular weight of the latex correlates to the melt viscosity or acid value of the material. The weight average molecular weight (Mw) and molecular weight distribution (MWD) of the latex may be measured by Gel Permeation Chromatography (GPC). The molecular weight may be from about 3,000 g/mole to about 150,000 g/mole, including from about 8,000 g/mole to about 100,000 g/mole, and in more particular embodiments from about 10,000 g/mole to about 90,000 g/mole.

The resulting polyester latex may have acid groups at the terminal of the resin. Acid groups which may be present include carboxylic acids, carboxylic anhydrides, carboxylic acid salts, combinations thereof, and the like. The number of carboxylic acid groups may be controlled by adjusting the starting materials and reaction conditions to obtain a resin that possesses excellent emulsion characteristics and a resulting toner that is environmentally durable.

Those acid groups may be partially neutralized by the introduction of a neutralizing agent, in embodiments a base solution, during neutralization (which occurs prior to aggregation). Suitable bases which may be utilized for this neutralization include, but are not limited to, ammonium hydroxide, potassium hydroxide, sodium hydroxide, sodium carbonate, sodium bicarbonate, lithium hydroxide, potassium carbonate, triethyl amine, triethanolamine, pyridine and its derivatives, diphenylamine and its derivatives, poly(ethylene amine) and its derivatives, combinations thereof, and the like. After neutralization, the hydrophilicity, and thus the emulsifiability of the resin, may be improved when compared with a resin that did not undergo such neutralization process. The resulting partially neutralized melt resin may be at a pH of from about 8 to about 13, in embodiments from about 11 to about 12.

The emulsifying agent present in the aggregated particle slurry may include any surfactant suitable for use in forming a latex resin. Surfactants which may be utilized during the emulsification stage in preparing latexes with the processes of the present disclosure include anionic, cationic, and/or nonionic surfactants. Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid, combinations thereof, and the like. Other suitable anionic surfactants include, in embodiments, DOWFAX® 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, mixtures thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, and the like, and mixtures thereof. The choice of particular surfactants or combinations thereof as well as the amounts of each to be used are within the purview of those skilled in the art.

Colorants which may be present in the aggregated particle slurry include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

The colorant may be present in the aggregated particle slurry in an amount of from about 1 to about 25 percent by weight of solids (i.e. the slurry minus solvent), in embodiments in an amount of from about 2 to about 15 percent by weight of solids.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP604™, NP608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™ PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI-60710, CI Dispersed Red 15, diazo dye identified in the Color. Index as CI-26050, CI Solvent Red 19, CI 12466, also known as Pigment Red 269, CI 12516, also known as Pigment Red 185, copper tetra(octadecyl sulfonamido) phthalocyanine, x-copper phthalocyanine pigment listed in the Color Index as CI-74160, CI Pigment Blue, Anthrathrene Blue identified in the Color Index as CI-69810, Special Blue X-2137, diarylide yellow 3,3-dichlorobenzidene acetoacetanilides, a monoazo pigment identified in the Color Index as CI 12700, CI Solvent Yellow 16, CI Pigment Yellow 74, a nitrophenyl amine sulfonamide identified in the Color Index as Foron Yellow SE/GLN, CI Dispersed Yellow 33,2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

A wax may also be present in the aggregated particle slurry. Suitable waxes include, for example, submicron wax particles in the size range of from about 50 to about 500 nanometers, in embodiments of from about 100 to about 400 nanometers.

The wax may be, for example, a natural vegetable wax, natural animal wax, mineral wax and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., Viscol 550-P, a low weight average molecular weight polypropylene available from Sanyo Kasel K.K., and similar materials. In embodiments, commercially available polyethylene waxes possess a molecular weight (Mw) of from about 1,000 to about 1,500, and in embodiments of from about 1,250 to about 1,400, while the commercially available polypropylene waxes have a molecular weight of from about 4,000 to about 5,000, and in embodiments of from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight of solids, and in embodiments from about 2 to about 20 percent by weight of solids.

An aggregating agent may also be present in the aggregated particle slurry. Any aggregating agent capable of causing complexation can be used/present. Both alkali earth metal or transition metal salts may be utilized as aggregating agents. In embodiments, alkali (II) salts may be selected to aggregate sodium sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally mixtures thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, mixtures thereof, and the like. When present, the coagulant is used in an amount from about 0.01 to about 8 percent by weight of solids, in embodiments from about 0.15 to about 0.8 percent by weight of solids.

An ionic coagulant having an opposite polarity to any ionic surfactant in the latex (i.e., a counterionic coagulant) may optionally be present in the aggregated particle slurry as well. Coagulant can be used, for example, to prevent/minimize the appearance of fines in the slurry. Fines refers, in embodiments, for example, to small sized particles of less than about 6 microns in average volume diameter, in embodiments from about 2 microns to about 5 microns in average volume diameter, which fines, may adversely affect toner yield. Counterionic coagulants may be organic or inorganic entities. Exemplary coagulants that may be present include polymetal halides, polymetal sulfosilicates, monovalent, divalent or multivalent salts optionally in combination with cationic surfactants, mixtures thereof, and the like. Inorganic cationic coagulants include, for example, polyaluminum chloride (PAC), polyaluminum sulfo silicate (PASS), aluminum sulfate, zinc sulfate, or magnesium sulfate. For example, the slurry may include an anionic surfactant, and the counterionic coagulant may be a polymetal halide or a polymetal sulfo silicate. When present, the coagulant is used in an amount from about 0.02 to about 2 percent by weight of solids, in embodiments from about 0.1 to about 1.5 percent by weight of solids.

The aggregated particle slurry may also include any known charge additives in amounts of from about 0.1 to about 10 weight percent, and in embodiments of from about 0.5 to about 7 weight percent of solids. Examples of such charge additives include alkyl pyridinium halides, bisulfates, negative charge enhancing additives like aluminum complexes, and the like.

Surface additives may be present in the aggregated particle slurry. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of solids. Other additives include zinc stearate and AEROSIL R972® available from Degussa. The coated silicas of U.S. Pat. Nos. 6,190,815 and 6,004,714, the disclosures of each of which are hereby incorporated by reference in their entirety, may also be present in an amount of from about 0.05 to about 5 percent, and in embodiments of from about 0.1 to about 2 percent of solids.

Prior to being processed into a coalesced particle slurry, the aggregated particle slurry contains aggregated particles which have an average diameter ranging from about 3 microns (μm) to about 25 μm, or in more specific embodiments a diameter of from about 4 μm to about 15 μm. The average diameter is reported as the $D_{50}$, or the diameter at which 50% of the particles have a lower diameter and 50% of the particles have a greater diameter.

The aggregated particle slurry may have a GSDv and/or a GSDn of from about 1.05 to about 1.55. The GSDv refers to the upper geometric standard deviation (GSDv) by volume (coarse level) for ($D_{84}/D_{50}$). The GSDn refers to the geometric standard deviation (GSDn) by number (fines level) for ($D_{50}/D_{16}$). The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles.

The particles in the aggregated particle slurry may have a circularity of from about 0.80 to about 0.95. The circularity is a measure of the particles' closeness to perfectly spherical. A circularity of 1.0 identifies a particle having the shape of a perfect circular sphere. The volume average circularity may be measured though Flow Particle Image Analysis (FPIA), provided for example by the Sysmex® Flow Particle Image Analyzer, commercially available from Sysmex Corporation.

The aggregated particle slurry has a basic "starting" pH, generally between about 7 and about 10, or in more specific embodiments from about 7 to about 9, or from about 7 to about 8.

Continuous Coalescence Process

The continuous coalescence processes of the present disclosure begin with preparing the aggregated particle slurry to be used in a coalescence system of the present disclosure. FIG. 1 is a schematic diagram illustrating the various components of an apparatus 100 that can be used to practice the continuous coalescence processes of the present disclosure. As illustrated here, the apparatus includes a passage that passes through an inlet 102, an outlet 104, a first heat exchanger 110, a residence time reactor 120, and a second heat exchanger 130. The two heat exchangers may be standard shell-tube heat exchangers, spiral heat exchangers, plate heat exchangers, or any other kind of heat exchanger. Each heat exchanger has a primary side and a secondary side through which different fluids flow, each side having an inlet and an outlet. A holding tank 170, a pump 180, and a receiving tank 190 are also used with the apparatus. The use of these components will now be described herein.

The aggregated polyester particle slurry may be provided from a holding tank 170 or from a batch aggregation process that passes directly into the first heat exchanger 110. After aggregation, the aggregated particle slurry may have a temperature of from about 40° C. to about 50° C., and a pH in the range of from about 3 to about 10, or from about 5 to about 9, or from about 7 to about 8.

Initially, the aggregated polyester particle slurry is less than the glass transition temperature of the polyester from which the aggregated particles are formed. The aggregated particle slurry can enter the inlet 102 of the apparatus either directly from the aggregation process, or can be processed from a stored batch. If processed from a stored batch, the temperature of the slurry may be at ambient temperature. If desired, the aggregated particle slurry can be heated before being fed into the inlet. The starting temperature of the aggregated particle slurry can thus be, for example, from ambient up to 65° C., or could be from about 40° C. to about 50° C. if fed directly from the aggregation process. If the feed temperature within the holding tank is too high after the pH has been adjusted downwards (to be more acidic), coalescence can take place in the holding tank, which would be undesirable as the circularity entering the coalescence system will be increasing as a function of time, leading to an increased distribution of mean circularity at the outlet of the coalescence system.

In some embodiments, the aggregated particle slurry can be pre-heated above the glass transition temperature of the resin before entering the first heat exchanger to coalesce the particles. For example, in embodiments, the temperature of the preheating may be at a temperature of from about 5° C. to about 30° C. greater than the glass transition temperature of the resin, such as from about 7.5° C. to about 25° C. greater than the glass transition temperature of the resin, or from about 10° C. to about 20° C. greater than the glass transition temperature of the resin. In some embodiments, the temperature of the preheating may be a temperature of from about ($T_g$+5° C.) to about ($T_g$+30° C.), such as from about ($T_g$+7.5° C.) to about ($T_g$+25° C.), or from about ($T_g$+10° C.) to about ($T_g$+20° C.). In embodiments, for example, the toner slurry may be preheated to about 65° C.

In embodiments, the toner slurry may be preheated to a temperature greater than the glass transition temperature of the resin as a batch process in the aggregation vessel, or in a second vessel, before introducing the toner slurry to the heat exchanger system to continuously coalesce the particles. Preheating the slurry in the aggregation vessel prior to adding the slurry to the heat exchanger system eliminates the need for an additional piece of reaction equipment to carry out the preheating step.

In embodiments, the frozen and/or aggregated toner slurry may be preheated to a temperature greater than the glass transition temperature of the resin before the toner slurry is added to the heat exchanger system by using a separate heat exchanger. This separate heat exchanger may be located before introducing the toner slurry to the heat exchanger system to continuously coalesce the particles.

It is believed that by doing so, the weakly aggregated toner particles fuse together. This makes the aggregated particles more robust against temperature changes from the very high rate of heating in the first heat exchanger 110, and reduces generation of fines during coalescence. The term "fines" refers to particles having less than about 3 μm volume median diameter.

The preheated toner slurry may be introduced to the heat exchanger system immediately after being heated to a temperature greater than the glass transition temperature of the resin, or may be cooled and/or stored before being introduced into the heat exchanger system. Once the toner slurry, such as a frozen and aggregated toner slurry, has been preheated, the slurry may be added to the heat exchanger system at a temperature greater or less than the glass transition temperature of the resin. In other words, if the toner slurry, such as a frozen and aggregated toner slurry, has once been preheated to a temperature greater than the glass transition temperature of the resin, the toner slurry may be introduced to the heat exchanger system at a temperature less than the glass transition temperature of the resin without the generation of fines—that is, a toner slurry that has been cooled need not be reheated before being introduced into the heat exchanger system to avoid the generation of fines.

In embodiments, the step of preheating the toner slurry may serve to decrease temperature shock on the slurry when the slurry passes through the second (higher temperature) heat exchanger. Preheating the slurry by means of batch vessel or heat exchanger may also allow for some partial coalescence in the first heat exchanger. In embodiments this partial coalescence in the first heat exchanger may represent 2% to 20% of the coalescence process, or 5% to 15% of the coalescence process. For example, in embodiments, the partial coalescence in a separate heat exchanger or batch vessel may result in the particles that may have a mean circularity of from about 0.88 to about 0.94, such as from about 0.89 to about 0.93, or from about 0.90 to about 0.93. This initial fusing may yield more robust toner particles after the particles pass through the higher-temperature heat exchanger, thereby preventing the large generation of fines. If the feed slurry is to be heated in a batch vessel, it is desirable that the temperature and pH be such that the rate of coalescence within the batch vessel is not significant with respect to the total feeding time as to prevent broadening of the distribution of mean circularities at the outlet of the coalescence system.

In embodiments, the pH of the aggregated polyester particle slurry is lowered to a pH of about 5 to about 8, either prior to being drawn through the inlet 102 of the apparatus or after passing through the first heat exchanger 110. This can be done by the addition of a buffer solution or an acidic solution to the aggregated particle slurry. Suitable acids for the acidic solution include nitric acid, sulfuric acid, hydrochloric acid, citric acid, acetic acid, and mixtures thereof. Exemplary buffer solutions include acetic acid/sodium acetate (pH=5.7). Preferably, the pH adjustment is made prior to heating the aggregated slurry, to reduce coarse particle generation due to localized regions of low pH that can otherwise occur during addition of the buffer solution/acidic solution.

Next, the aggregated particle slurry is drawn from the holding tank 170 and passes through the inlet 102 into a first heat exchanger 110. In the first heat exchanger, the aggregated polyester particle slurry is further heated to a first temperature that is greater than the glass transition temperature of the polyester. In particular embodiments, the first temperature is from about 70° C. to about 110° C., or from about 80° C. to about 96° C. Line 112 represents the hot secondary fluid used to heat the particle slurry, and line 114 represents the cooled secondary fluid exiting the first heat exchanger.

Coalescence occurs at the elevated temperature and the lowered pH. The now heated aggregated polyester particle slurry, having this first temperature, subsequently requires a local coalescence residence time for the aggregated particles to coalesce. The local coalescence residence time may be from about 10 seconds to about 15 minutes, including from about 10 seconds to about 10 minutes, or from about 15 seconds to about 5 minutes, or from about 30 seconds to about 2 minutes. As used herein, "coalescence residence time" refers to the time the particle slurry spends at a target temperature.

In some embodiments, as illustrated here in FIG. 1, the coalescence residence time is obtained by flowing the now-heated polyester particle slurry through a residence time reactor 120. Generally, the residence time reactor comprises a housing 122 surrounding an internal volume 124. For example, the reactor may simply be a tube having a large diameter, or may be a relatively longer tube with a smaller diameter. A coalesced particle slurry is formed in the residence time reactor. The circularity of the coalesced particles can be controlled by adjusting the pH, residence time (flow rate), and temperature of the slurry. Higher circularities are achieved with higher temperatures, lower flow rates, or lower pH. It should also be mentioned that in certain embodiments, no mixing elements (static or rotating) are present in the residence time reactor. Generally, no moving parts are present in the residence time reactor. It should also be mentioned that it is desirable for the flow pattern within the residence time reactor to have plug-flow characteristics as variations in residence time within the residence time reactor will lead to variations in the distribution of mean circularities at the outlet for the coalescence process.

Figure 2:
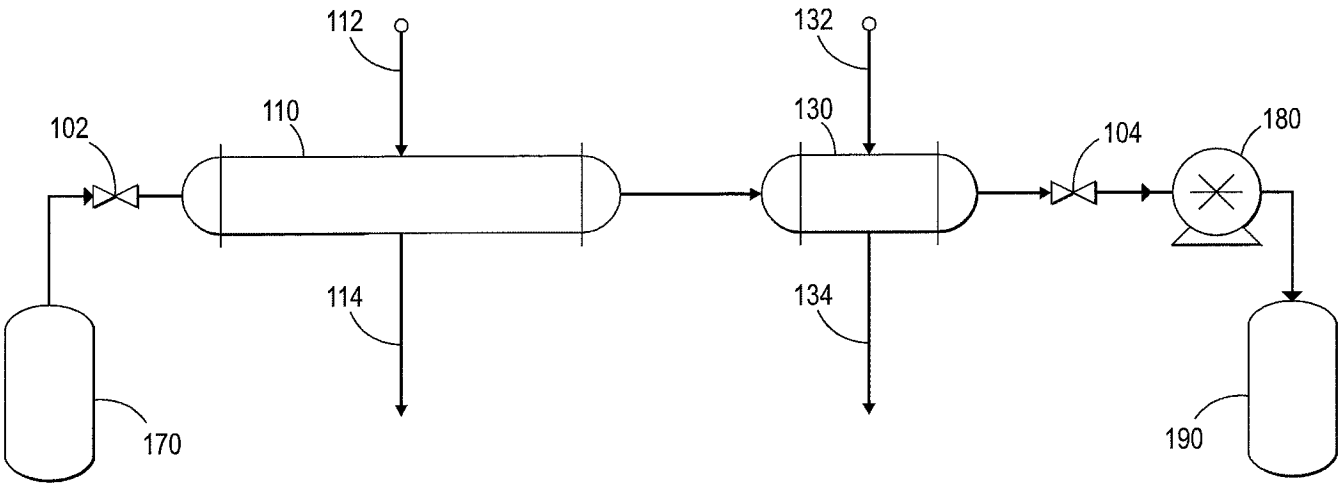
FIG. 2 is a schematic diagram illustrating a second exemplary apparatus suitable for practicing the processes of the present disclosure. This apparatus includes an oversized first heat exchanger for heating the slurry, and a second heat exchanger for quenching the slurry. No residence time reactor is present here.

In other embodiments, the coalescence residence time for coalescence can occur within the first heat exchanger, for example if the first heat exchanger is oversized such that the elevated first temperature is achieved within the first heat exchanger. This is illustrated in FIG. 2, with the first heat exchanger 110 being depicted as having a greater size than that of FIG. 1. In FIG. 2, no residence time reactor is present.

After residing in the residence time reactor 120, the coalesced particle slurry is quenched, or in other words its temperature is reduced to a second temperature below the glass transition temperature. In particular embodiments, the second temperature is less than 40° C. This quenched coalesced particle slurry then exits the apparatus through outlet 104. The coalesced particle slurry may then be sent to a receiving tank 190.

As depicted here, the quenching occurs in a second heat exchanger 130. However, other structures are also contemplated. The general requirement is simply that the temperature of the particles be reduced below the glass transition temperature. This could happen, for example, in the residence time reactor as well. A cooled receiving tank, for example a jacketed CSTR, could also be used for the quenching. As illustrated here, line 132 represents a cool secondary fluid used to quench the particle slurry, and line 134 represents the warmed secondary fluid exiting the second heat exchanger.

The coalesced particle slurry contains coalesced particles which have an average diameter ranging from about 3 microns (μm) to about 25 μm, or in more specific embodiments a diameter of from about 4 μm to about 15 μm. The coalesced particle slurry may have a GSDv and/or a GSDn of from about 1.15 to about 1.30. The particles in the coalesced particle slurry may have a mean circularity of from about 0.930 to about 0.995, such as from about 0.940 to about 0.990, or from about 0.945 to about 0.985. The coalesced particle slurry contains from about 10 wt % to about 20 wt % of solids, and contains from about 80 wt % to about 90 wt % of solvent (typically water).

As depicted here, the slurry can be drawn through the system/apparatus by means of pressurized transfer. The flow rate is controlled by a pump 180 located beyond the outlet 104 of the system/apparatus. The pump can be located here instead of placing a pump between the holding tank 170 and the inlet 102 to reduce handling of the aggregated, non-coalesced slurry, which may degrade the particle size and particle size distribution of the incoming aggregated particle slurry. As a result, the system/apparatus can operate at a pressure of from about 5 psi to about 50 psi in order to allow for pressurized transfer. However, generally any means can be used to move the aggregated particle slurry through the system/apparatus. In some embodiments, the implementation of the preheating step prior to coalescence may mitigate the degradation of particle size distribution when the pump is placed between the holding tank 170 and the inlet 102 as the aggregated latex particles partially fuse together and thereby become more resilient to breakup from the shearing action of a pump.

In some embodiments, when a temperature of beyond 100° C. is utilized in at least one heat exchanger, the system may be pressurized to a pressure that is greater than the vapor pressure of water to suppress boiling of the aqueous component of the slurry. In embodiments, the pressure of one or more of the heat exchangers of the system and/or the entire system may be maintained at a predetermined temperature and pressure where the pressure may be from about 1% to about 800% greater than the vapor pressure of water (at the predetermined temperature), such as from about 1% to about 20% greater, or from about 5% to about 10% greater, or from about 10% to about 30% greater than the vapor pressure of water (at the predetermined temperature), or from about 15% to about 25% greater than the vapor pressure of water (at the predetermined temperature). In embodiments, for a given temperature, the pressure of one or more of the heat exchangers of the system and/or the entire system may be about 10% greater than the vapor pressure of water. It should be noted that the vapor pressure of water at 100° C. is 1 atmosphere (atm), so the pressure of the heat exchanger system would be greater than 1 atm. In embodiments, the pressure of the system may be maintained at a predetermined pressure by a back pressure regulator, a peristaltic pump, a gear pump, or a progressive cavity pump. The system may maintain a predetermined pressure by discharging through a back-pressure regulating diaphragm valve or any other means of facilitating back pressure regulation of a particle laden aqueous slurry, which allows for discharge to the atmosphere.

Figure 3:
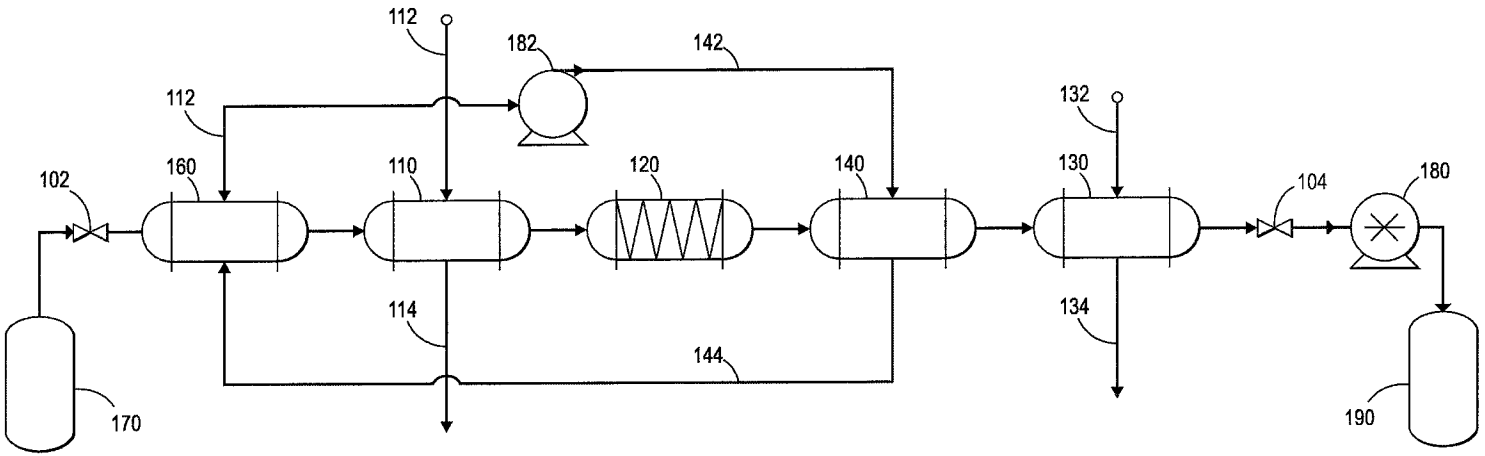
FIG. 3 is a schematic diagram illustrating a third exemplary apparatus suitable for practicing the processes of the present disclosure. This apparatus includes a first heat exchanger for heating the slurry, a residence time reactor, and a second heat exchanger for quenching the slurry. A third heat exchanger and a fourth heat exchanger are also included, and form a loop to recycle heat energy present after coalescence upstream to heat the aggregated slurry.
Figure 4A:
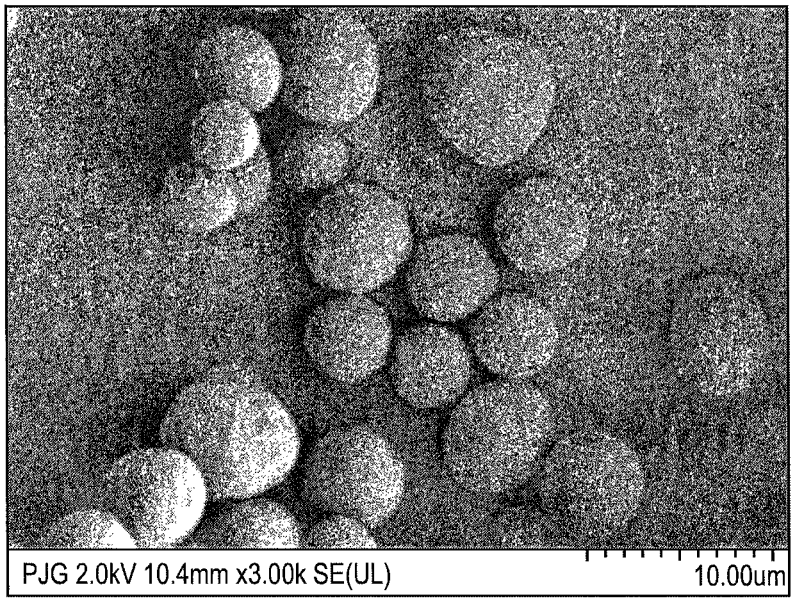
FIGS. 4A-4D are a set of four micrographs showing the particles produced according to Example 2.
Figure 4B:
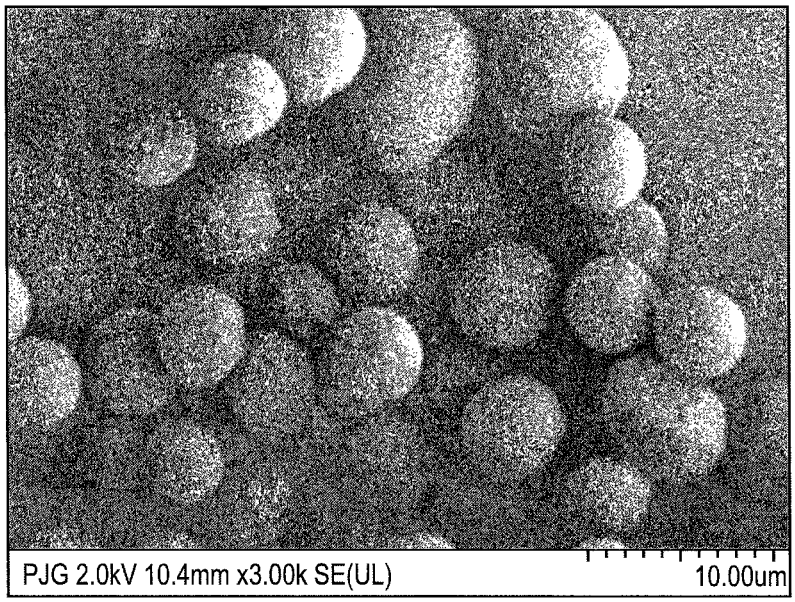
Figure 4C:
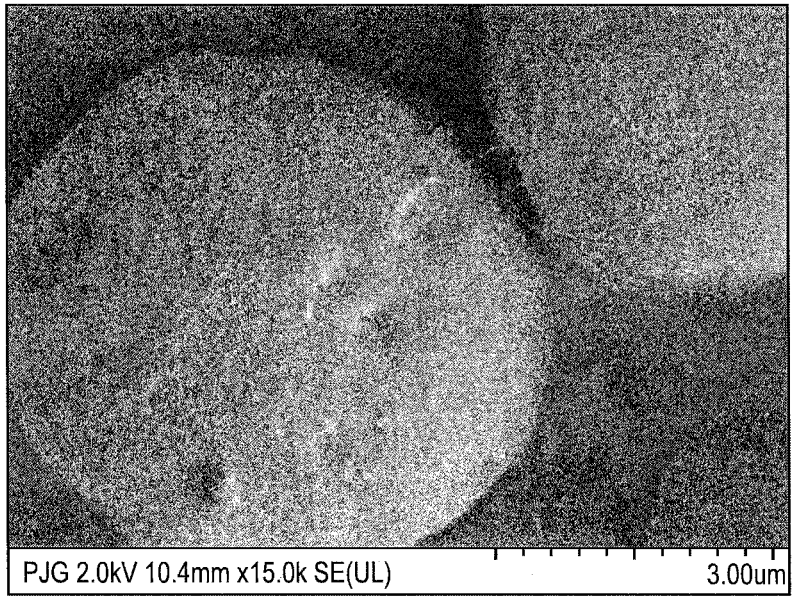
Figure 4D:
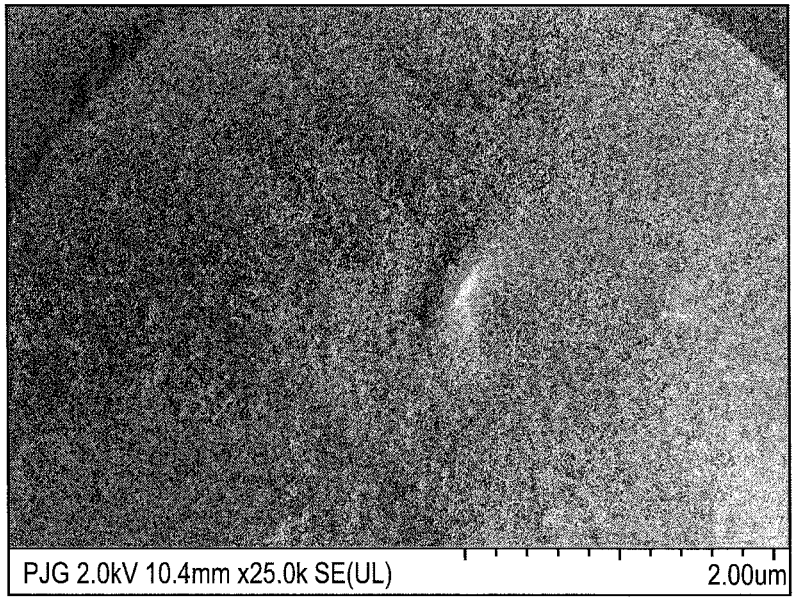
Figure 5A:
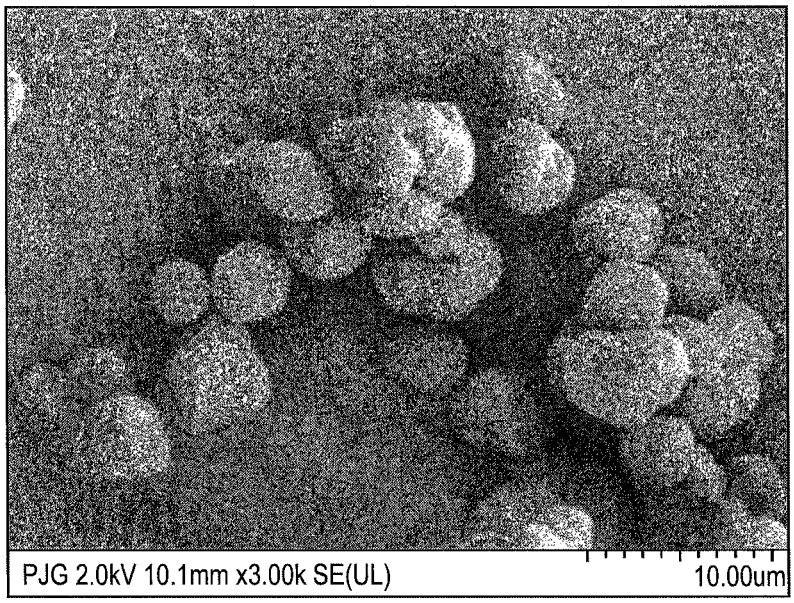
FIGS. 5A-5D are a set of four micrographs showing the particles produced according to Example 3.
Figure 5B:
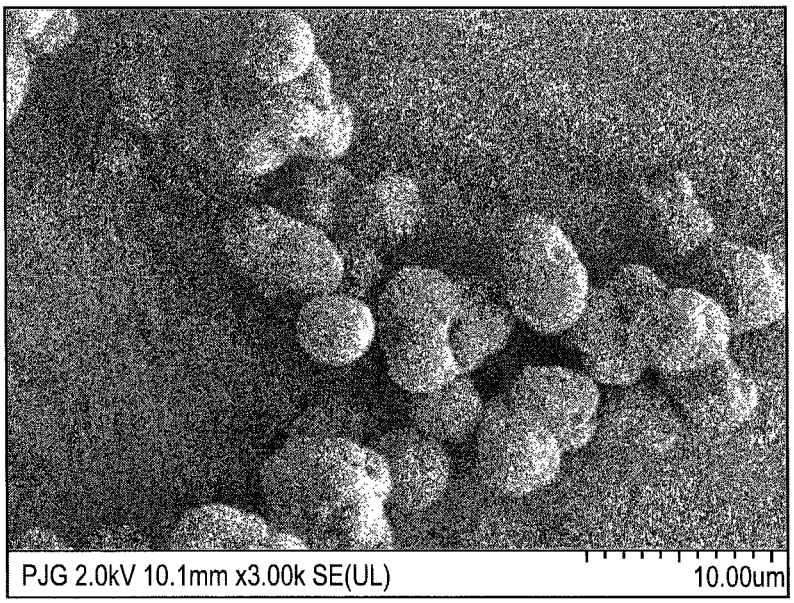
Figure 5C:
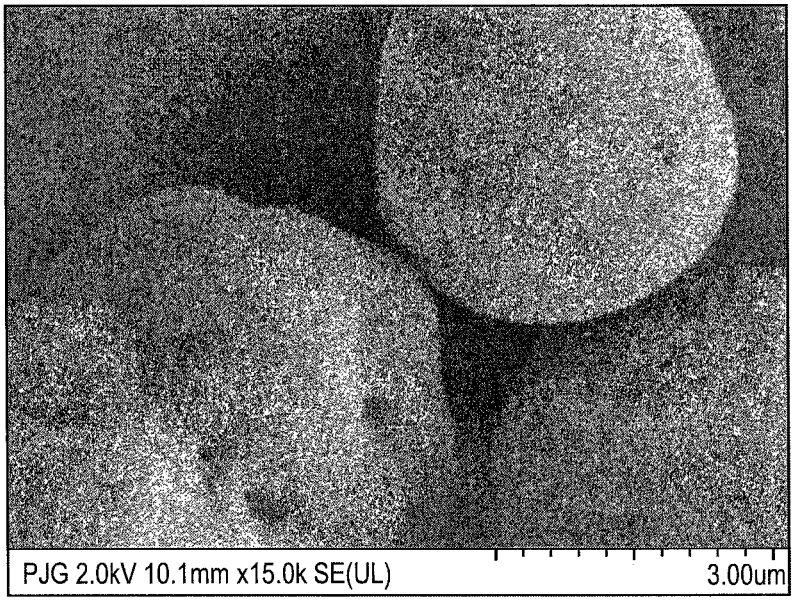
Figure 5D:
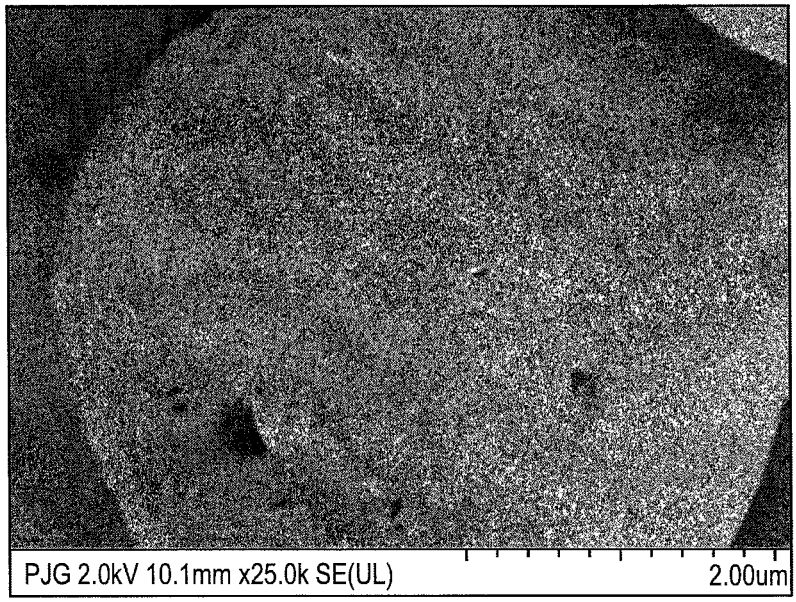
Figure 6A:
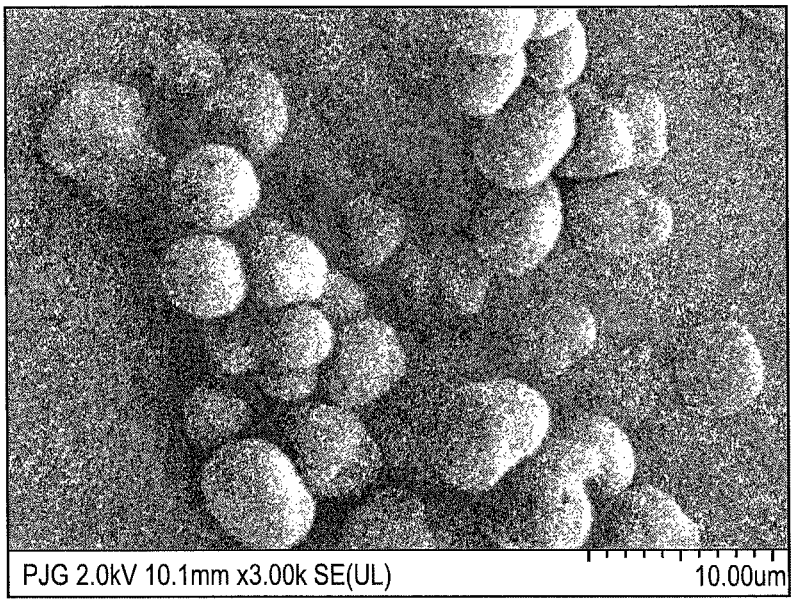
FIGS. 6A-6D are a set of four micrographs showing the particles produced according to Example 7.
Figure 6B:
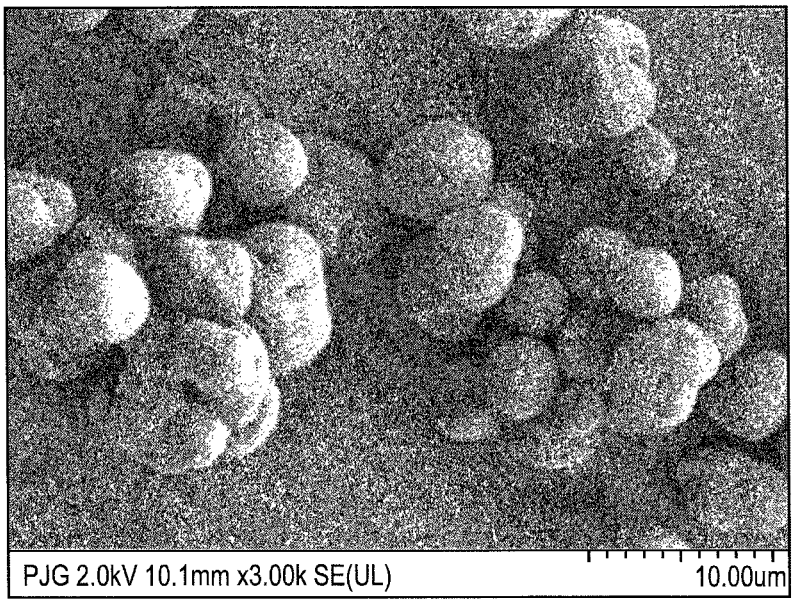
Figure 6C:
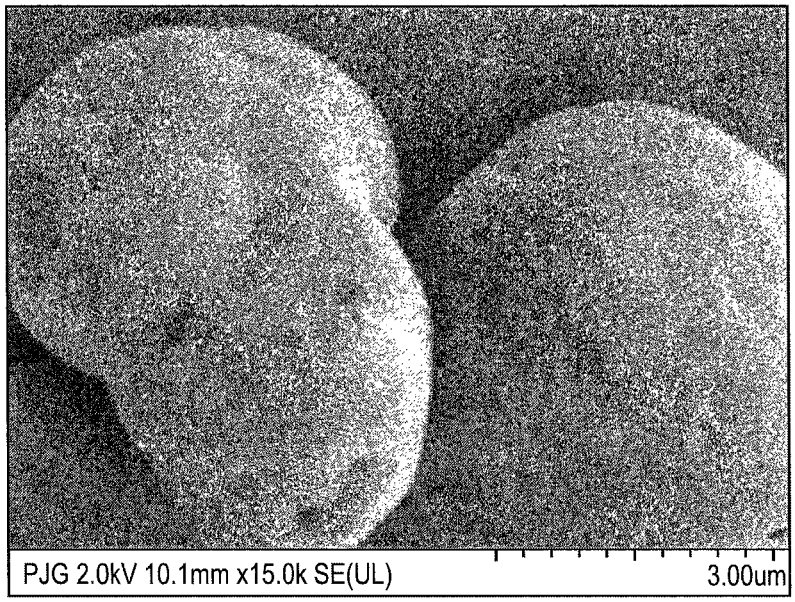
Figure 6D:
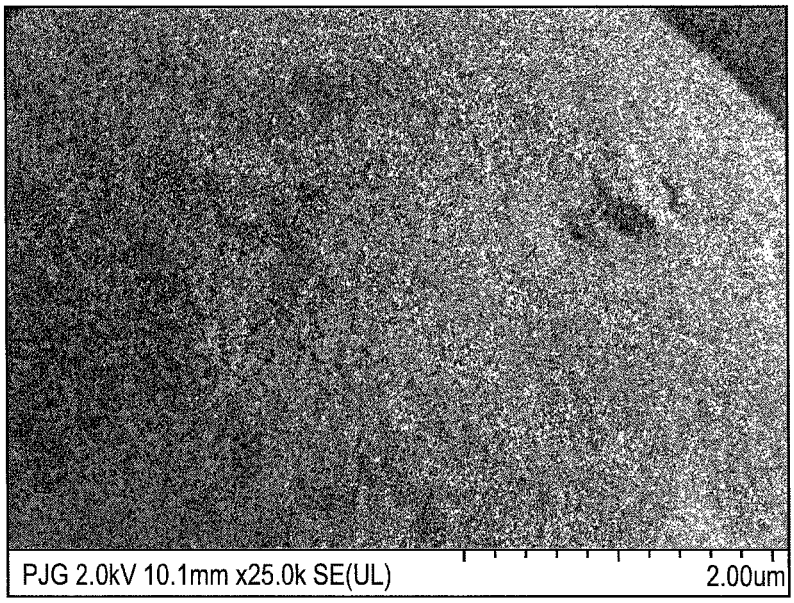
Figure 7A:
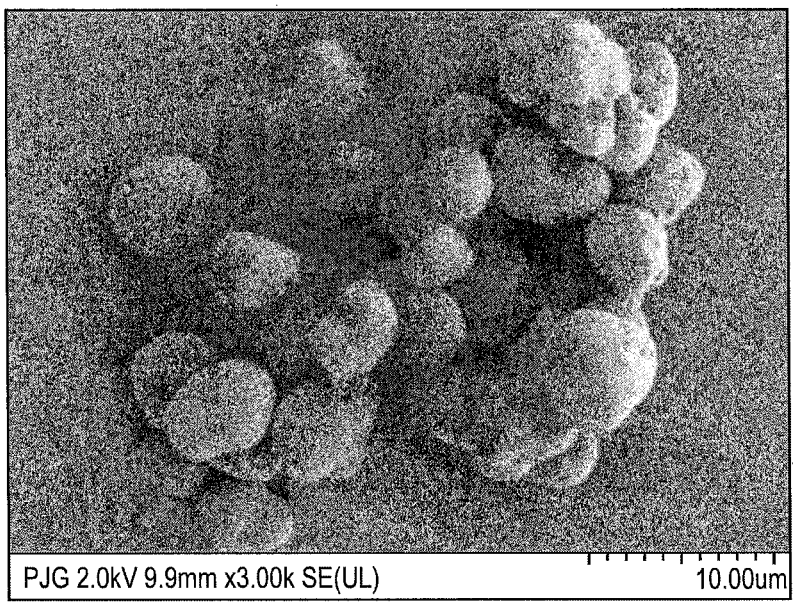
FIGS. 7A-7D are a set of four micrographs showing the particles produced according to Example 8.
Figure 7B:
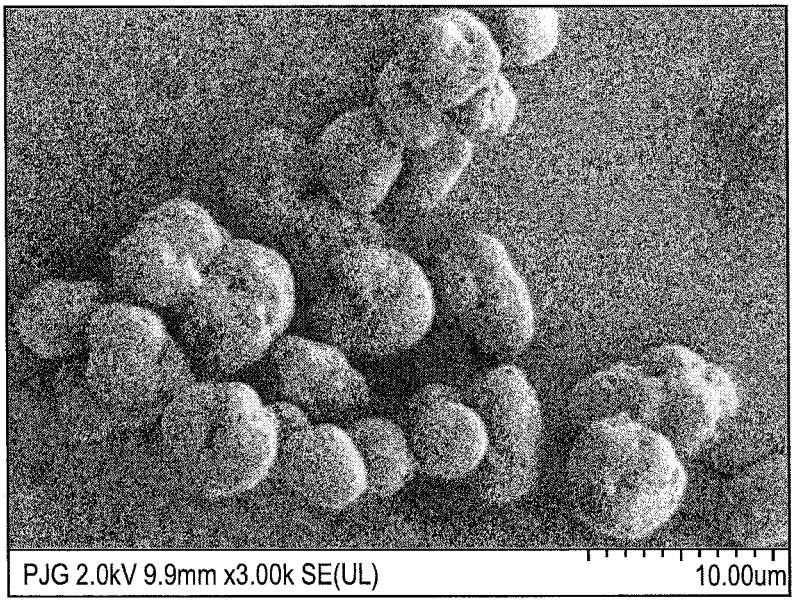
Figure 7C:
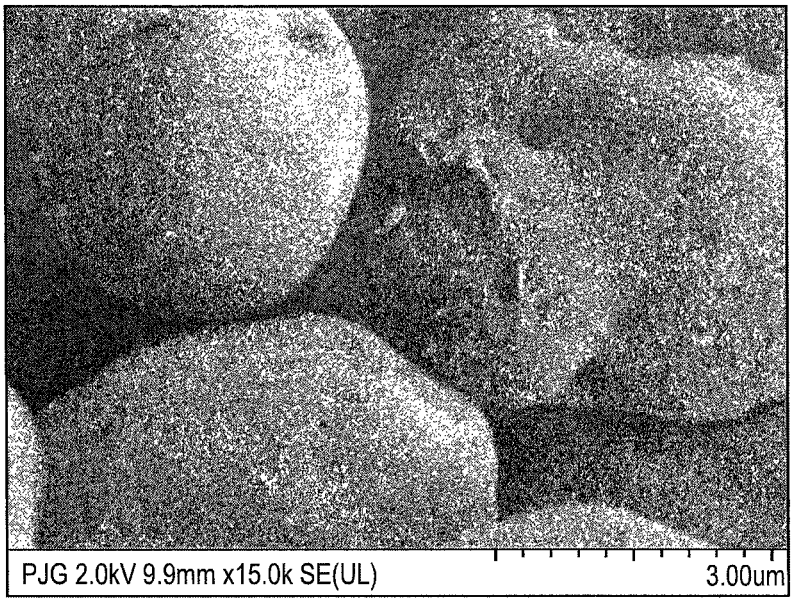
Figure 7D:
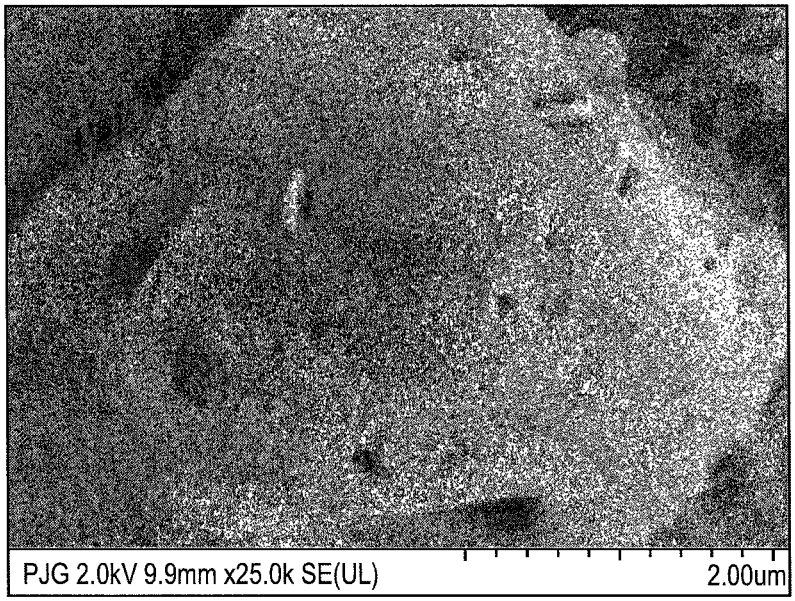

In some embodiments, the heat energy present in the coalesced particle slurry may be captured and operatively transferred to the aggregated particle slurry prior to coalescence. One exemplary mechanism for doing so is illustrated in FIG. 3. After the particle slurry passes through the first heat exchanger 110 and the residence time reactor 120, the coalesced particle slurry passes through a third heat exchanger 144 that cools the slurry before the slurry is quenched in the second heat exchanger 130. The fluid used to capture the heat energy in the third heat exchanger 140 travels via line 144 to a fourth heat exchanger 160, where the heat energy is transferred to the incoming aggregated particle slurry. The fluid is then recycled back to the third heat exchanger 140 via line 142 and pump 182. Due to heat loss, the energy transferred in this recycling loop 140/144/160/142 is insufficient to cause coalescence to begin in the aggregated particle slurry to the first temperature of about 70° C. to about 110° C. Rather, coalescence begins in the first heat exchanger 110. The heat transfer liquid present in the loop can be glycol or another oil which has a high heat absorption capacity.

The continuous coalescence processes of the present disclosure reduce cycle time, reduce downtime due to cleaning, and increase yield. In addition, energy used in heating the slurry may be partially recovered, reducing overall energy consumption and increasing efficiency.

The following examples are for purposes of further illustrating the present disclosure. The examples are merely illustrative and are not intended to limit the disclosure to the materials, conditions, or process parameters set forth therein.

EXAMPLES

Example 1

Preparation of an Aggregated Polyester Toner Particle Slurry

Two amorphous emulsions (7.9 kg polyester A (Mw=86,000, Tg onset=56° C., 35% solids) and 7.7 kg polyester B (Mw=19,400, Tg onset=60° C., 35% solids)), 2 kg crystalline polyester C (Mw=23,300, Mn=10,500, Tm=71° C., 36% solids), 3.2 kg polyethylene wax emulsion (Tm=90° C., 32% solids, The International Group, Inc. (IGI)), 4.2 kg black pigment (Nipex-35, Evonik, 17% solids) and 706 g cyan pigment (PB 15:3 Dispersion, 17% solids), 28 kg de-ionized water, were mixed in a reactor, then pH adjusted to 4.2 using 0.3M nitric acid. The slurry then was treated in a CAVITRON homogenizer with the use of a re-circulating loop for a total of 50 minutes, where during the first 5 minutes the coagulant, consisting of 55 grams aluminum sulphate solution mixed with 2.6 kg deionized (DI) water, was added inline. The reactor mixing speed was increased from 85 rpm to 275 rpm once all the coagulant was added. The slurry then was aggregated at a batch temperature of 42° C. During aggregation, a shell comprised of the same amorphous resins as in the core (4.5 kg polyester A emulsion and 4.4 kg polyester B emulsion) were mixed and was pH adjusted to 3.3 with nitric acid, and the mixture was added to the batch. The batch was heated further to achieve the targeted particle size. Once the target particle size was reached, the aggregation step was frozen with pH adjustment to 7.8 using NaOH and an EDTA solution (165 grams EDTA with 258 grams de-ionized water). The contents of the reactor were then ramped and heated to about 65° C. for about 15 minutes before being discharged for processing by continuous coalescence. This batch was then used for subsequent continuous coalescence experiments over a period of several weeks with no degradation in particle size or GSD.

Example 2

Bench Scale Continuous Coalescence

In this experiment, an aggregated polyester toner particle slurry was prepared in a 20-gallon batch reactor as per Example 1.

A holding tank was filled with about 4 L of the aggregated slurry and heated to 65° C. (pH adjustment temperature), then adjusted to a pH of 6.6 using a sodium acetate/acidic acid buffer (pH=5.7). The holding tank was then sealed and pressurized to 40 psi. The volumetric flow rate through the process was regulated at the outlet by means of a peristaltic pump to a rate of 240 g/min.

The aggregated slurry was passed through the tube-side of two heat exchangers (tubeset volume of about 122 mL, each) arranged in series and designated HEX1/HEX2. The shell-side (jacket) temperature of these two heat exchangers was set to 110° C. The aggregated slurry then passed through the residence time reactor having a volume of ~234 mL. At the set volumetric flow rate, this yielded a heated residence time of about 1 minute within the residence time reactor. The slurry then passed directly through the tube-side of a final heat exchanger (HEX3) which was cooled by cold water on the shell-side (jacket) to quench the slurry and give a temperature below 40° C. The resulting mean circularity as measured on a FPIA-Sysmex 3000 was found to be 0.992. The coalesced toner particles were then washed/dried using conventional procedures.

FIGS. 4A-4D are a collection of four scanning electron microscope (SEM) micrographs of the resulting coalesced particles at various magnifications. The resulting particles have a relatively smooth surface.

Examples 3-14

Bench Scale Continuous Coalescence

Examples 3-14 were carried out in the same manner as Example 2, but used the different pH, flowrate, and temperature conditions listed in Table 1. Examples 11-14 were also not reheated to 65° C. prior to being fed into the continuous coalescence system, and the pH was adjusted at 20° C.

FIGS. 5A-5D are a collection of four scanning electron microscope (SEM) micrographs of the resulting coalesced particles of Example 3 at various magnifications. Compared to Example 2, the particles are less circular and have a somewhat larger surface area.

FIGS. 6A-6D are a collection of four scanning electron microscope (SEM) micrographs of the resulting coalesced particles of Example 7 at various magnifications. Compared to Example 2, the particles are less circular and have a somewhat larger surface area.

FIGS. 7A-7D are a collection of four scanning electron microscope (SEM) micrographs of the resulting coalesced particles of Example 8 at various magnifications. Compared to Example 2, the particles are less circular and have a somewhat larger surface area.

Example 15

Pilot Scale Continuous Coalescence

In this experiment, an aggregated polyester toner particle slurry was prepared in a 20-gallon batch reactor in the same manner as Example 1.

A holding tank was filled with about 70 L of the aggregated slurry and then adjusted to a pH of 6.4 at about 20° C. (pH adjustment temperature) using a sodium acetate/acidic acid buffer (pH=5.7). The holding tank was then sealed and pressurized to 40 psi. The volumetric flow rate through the process was regulated at the outlet by means of a peristaltic pump to a rate of 2.7 kg/min.

The aggregated slurry was passed through the tube-side of two heat exchangers (tubeset volume of about 1.4 L, each) arranged in series and designated HEX1/HEX2. The shell-side (jacket) temperature of these two heat exchangers was set to 110° C. The aggregated slurry then passed through the residence time reactor having a volume of ~2.6 L. At the set volumetric flow rate, this yielded a heated residence time of about 1 minute within the residence time reactor. The slurry then passed directly through the tube-side of a final heat exchanger (HEX3) which was cooled by cold water on the shell-side (jacket) to quench the slurry and give a temperature below 40° C. The resulting mean circularity as measured on a FPIA-Sysmex 3000 was found to be 0.973. The coalesced toner particles were then washed/dried using conventional procedures.

TABLE 1

Examples 3-13 Bench Scale Continuous Coalescence.

| Example | Solids % | Feed pH | pH Adjustment Temperature (° C.) | Process Flow Rate (g/min) | Coalescence Temperature (° C.) | Circularity |
|---|---|---|---|---|---|---|
| Example 2 | 18.8 | 6.6 | 65 | 240 | 110 | 0.992 |
| Example 3 | 18.8 | 6.6 | 65 | 240 | 96.5 | 0.97 |
| Example 4 | 18.6 | 6.2 | 65 | 240 | 95.5 | 0.992 |
| Example 5 | 18.7 | 6.4 | 65 | 240 | 90.5 | 0.986 |
| Example 6 | 15.5 | 6.5 | 65 | 240 | 90 | 0.982 |
| Example 7 | 15.5 | 6.6 | 65 | 240 | 96 | 0.981 |
| Example 8 | 15.5 | 6.4 | 65 | 240 | 84 | 0.977 |
| Example 9 | 15.5 | 6.6 | 65 | 120 | 84 | 0.97 |
| Example 10 | 15.2 | 6.4 | 65 | 240 | 84 | 0.968 |
| Example 11 | 15.6 | 6.2 | 20 | 240 | 85 | 0.985 |
| Example 12 | 15.6 | 6.3 | 20 | 240 | 85 | 0.96 |
| Example 13 | 15.9 | 6.2 | 20 | 240 | 87 | 0.972 |
| Example 14 | 15.9 | 6.2 | 20 | 240 | 90 | 0.983 |

Examples 16-29

Pilot Scale Continuous Coalescence

Examples 3-13 were carried out in the same manner as Example 2 except for the different pH, flowrate, and temperature conditions listed Table 1.

TABLE 2

Examples 15-29 Pilot Scale Coalescence

| Example | Solids % | Feed pH | pH Adjustment Temperature (° C.) | Process Flow Rate (kg/min) | Coalescence Temperature (° C.) | Circularity |
|---|---|---|---|---|---|---|
| Example 15 | 14.9 | 6.4 | 20 | 2.7 | 84 | 0.973 |
| Example 16 | 15 | 6.4 | 20 | 2.7 | 80 | 0.958 |
| Example 17 | 15.5 | 6.4 | 20 | 2.7 | 90 | 0.966 |
| Example 18 | 15.25 | 6.2 | 20 | 2.7 | 90 | 0.987 |
| Example 19 | 14.8 | 6.4 | 20 | 2.35 | 90 | 0.984 |
| Example 20 | 15 | 6.4 | 20 | 2.35 | 85 | 0.975 |
| Example 21 | 14.8 | 6.4 | 20 | 2.35 | 90 | 0.976 |
| Example 22 | 14.8 | 6.4 | 20 | 2.7 | 90 | 0.973 |
| Example 23 | 14.8 | 6.4 | 20 | 3.04 | 90 | 0.97 |
| Example 24 | 14.8 | 6.4 | 20 | 2.35 | 95 | 0.987 |
| Example 25 | 14.8 | 6.4 | 20 | 2.7 | 95 | 0.983 |
| Example 26 | 14.8 | 6.4 | 20 | 3.04 | 95 | 0.984 |
| Example 27 | 14.8 | 6.6 | 20 | 2.35 | 95 | 0.969 |
| Example 28 | 14.8 | 6.6 | 20 | 2.7 | 95 | 0.967 |
| Example 29 | 14.8 | 6.6 | 20 | 3.04 | 95 | 0.964 |

Figure 8:
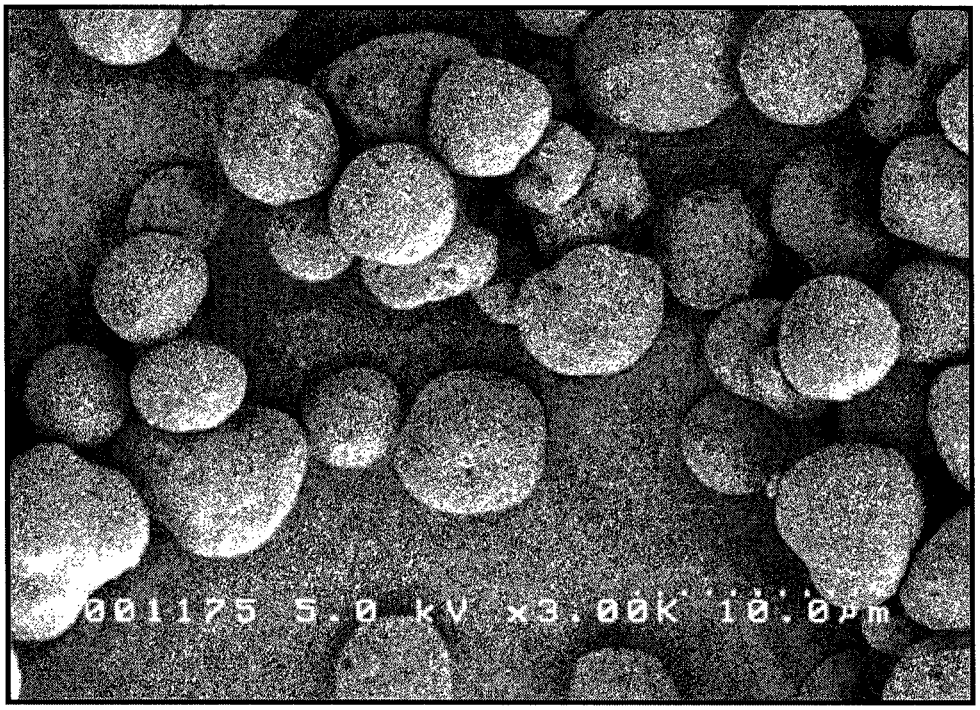
FIG. 8 is a micrograph showing particles produced according to Example 19. The micrograph is at 3,000× magnification.

FIG. 8 is a micrograph of the resulting coalesced particles of Example 19 at 3,000× magnification.

Figure 9:
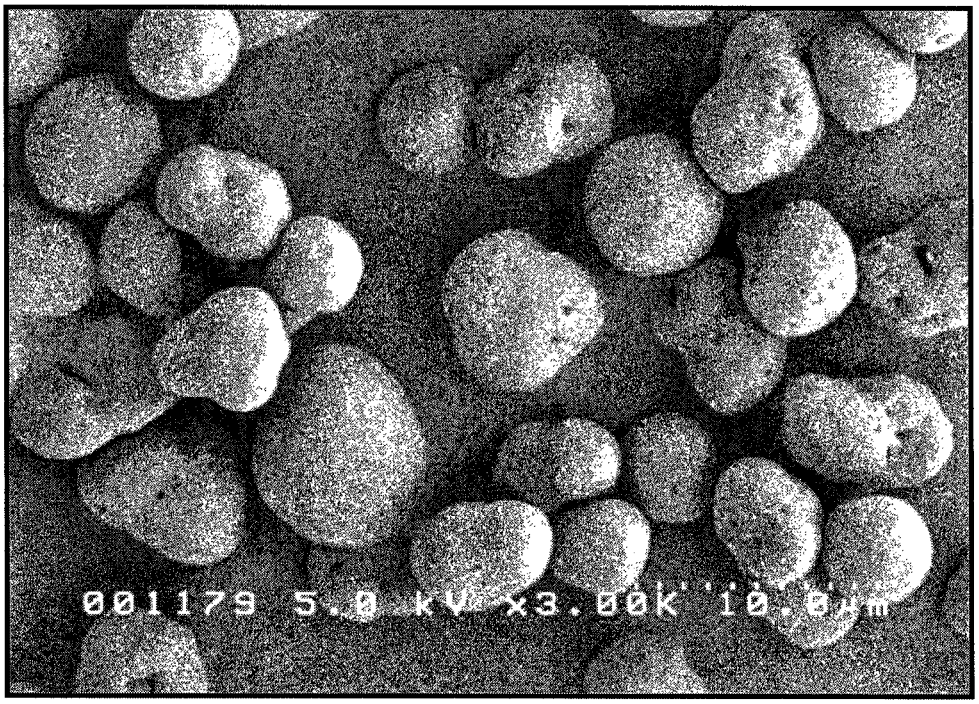
FIG. 9 is a micrograph showing particles produced according to Example 20. The micrograph is at 3,000× magnification.

FIG. 9 is a micrograph of the resulting coalesced particles of Example 20 at 3,000× magnification. Compared to FIG. 8, the particles are less circular.

BET Surface Area Measurements

The BET surface area was measured for some of the Examples, as listed below in Table 3. The BET surface area was measured using a Tristar BET instrument from Micromeritics. Samples were prepared by flowing nitrogen gas over particles heated at 30° C. for at least four hours. The gas was removed, and the particles were brought to room temperature, then weighed. The particles were then placed in the Tristar instrument. Nitrogen gas and adsorbate properties (0.162 $nm^2$) were entered into the analysis program. A seven-point series of partial pressures was used, with $P/P_o$ of 0.08, 0.10, 0.12, 0.14, 0.16, 0.18, and 0.20. The multipoint surface area and the single point surface area ($P/P_o$=approx. 0.3) were recorded. The $r^2$ value was 0.99 or better.

| Example | Multipoint BET surface area ($m^2/g$) | Single point BET surface area ($m^2/g$) |
|---|---|---|
| Example 3 | 1.53 | 1.34 |
| Example 7 | 1.55 | 1.37 |
| Example 8 | 1.18 | 1.03 |
| Example 9 | 1.57 | 1.37 |
| Example 11 | 1.21 | 1.07 |
| Example 13 | 1.26 | 1.11 |
| Example 14 | 1.12 | 0.99 |
| Example 15 | 1.39 | 1.17 |
| Example 16 | 2.45 | 2.12 |
| Example 17 | 1.86 | 1.62 |
| Example 18 | 1.22 | 1.03 |
| Example 19 | 1.21 | 1.05 |
| Example 20 | 1.28 | 1.10 |

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A continuous process for coalescing toner particles, comprising:

heating an aggregated polyester particle slurry to a first temperature beyond its glass transition temperature in a first heat exchanger to form a heated mixture;

coalescing the heated mixture in a residence time reactor to form a coalesced particle slurry;

quenching the coalesced particle slurry to a second temperature below the glass transition temperature after a residence time; and recovering the quenched coalesced particle slurry at an outlet;

wherein the circularity of the particles in the aggregated particle slurry is from about 0.900 to about 0.940, and the circularity of the particles in the coalesced particle slurry has increased to a value from about 0.940 to about 0.999; and wherein the residence time reactor has no moving parts.

2. The process of claim 1, wherein the aggregated polyester particle slurry has a starting temperature of from ambient to about 65° C. prior to entering the first heat exchanger.

3. The process of claim 1, wherein the aggregated polyester particle slurry has a starting temperature of from about (Tg+5° C.) to about (Tg+30° C.) prior to entering the first heat exchanger.

4. The process of claim 1, wherein the first temperature is from about 70° C. to about 110° C.

5. The process of claim 1, wherein the quenching occurs in a reactor, or in a second heat exchanger, or in a cooled receiving tank.

6. The process of claim 1, wherein a pressure of the first heat exchanger is from about 1% to about 20% greater than a vapor pressure of water at the first temperature.

7. The process of claim 1, wherein the heated polyester particle slurry exits the first heat exchanger and coalesces in a residence time reactor to form the coalesced particle slurry.

8. The process of claim 1, wherein the aggregated polyester particle slurry is drawn into the first heat exchanger by a pump at the outlet.

9. The process of claim 1, wherein the aggregated particle slurry has a starting pH of about 3 to about 10 prior to entering the first heat exchanger.

10. The process of claim 1, further comprising lowering the pH of the aggregated particle slurry prior to flowing the aggregated particle slurry through the residence time reactor.

11. The process of claim 10, wherein the pH of the aggregated particle slurry is lowered to a value from about 5 to about 8 prior to entering the first heat exchanger.

12. The process of claim 10, wherein the pH of the aggregated particle slurry is lowered by addition of a buffer solution or an acidic solution.

13. The process of claim 1, wherein the pH of the aggregated particle slurry is lowered after passing through the first heat exchanger.

14. The process of claim 1, wherein the residence time is from about 10 seconds to about 15 minutes.

15. The process of claim 1, wherein heat energy captured prior to quenching the coalesced particle slurry in a second heat exchanger is operatively transferred to the aggregated particle slurry prior to coalescence.

* * * * *